US006026606A

United States Patent [19]

Ross

[11] Patent Number: 6,026,606

[45] Date of Patent: Feb. 22, 2000

[54] DISPLAY DEVICE

[75] Inventor: Jerry A. Ross, North Hollywood, Calif.

[73] Assignee: Scanner Badges, Inc., Sherman Oaks, Calif.

[21] Appl. No.: 09/134,096

[22] Filed: Aug. 14, 1998

[51] Int. Cl.[7] ..... A47G 1/16; A47G 1/06

[52] U.S. Cl. ..... 40/761; 40/762; 40/764; 40/791; 40/792; 40/788; 40/789

[58] Field of Search ..... 40/761, 762, 745, 40/764, 790, 791, 792, 795, 788, 789, 703, FOR 155

[56] References Cited

U.S. PATENT DOCUMENTS

| | | | |
|---|---|---|---|
| 166,962 | 8/1875 | Bradford | 40/798 |
| 944,385 | 12/1909 | Spiegel | 40/789 X |
| 1,904,318 | 4/1933 | Lehere | 40/791 |
| 2,376,180 | 5/1945 | Paige | 40/764 |
| 2,538,386 | 1/1951 | Schneider | 40/798 |
| 4,275,520 | 6/1981 | Appleton et al. | 40/773 X |
| 4,858,358 | 8/1989 | Gagnon . | |
| 5,050,323 | 9/1991 | Gagnon . | |
| 5,072,532 | 12/1991 | Kelly | 40/798 X |
| 5,172,504 | 12/1992 | De Maat et al. | 40/729 X |
| 5,361,521 | 11/1994 | Burtch | 40/789 X |
| 5,367,802 | 11/1994 | Rosenberg | 40/798 X |
| 5,383,293 | 1/1995 | Royal | 40/768 |
| 5,400,533 | 3/1995 | Cruse | 40/798 X |
| 5,678,756 | 10/1997 | Sugiura | 40/789 X |
| 5,713,148 | 2/1998 | Lovison | 40/762 X |

*Primary Examiner*—Terry Lee Melius
*Assistant Examiner*—Rodrigo J. Morales
*Attorney, Agent, or Firm*—Pillsbury Madison & Sutro

[57] ABSTRACT

A display device for holding and displaying a document constituted by a thin sheet, the display device being composed of: a frame member enclosing a display area; at least one holding element for holding the document so that at least a portion of the document is visible in the display area; and support elements for supporting the frame member in an upright orientation on a horizontal support surface, wherein the at least one holding element is integral with the frame member.

13 Claims, 4 Drawing Sheets

DISPLAY DEVICE

BACKGROUND OF THE INVENTION

The present invention relates to display devices, particularly for displaying documents, such as photographs, drawings, art reproductions, certificates, or any other printed material that it may be desired to display.

One aspect of the invention relates particularly to display devices which provide a frame for an article to be displayed and are constructed to stand on a table top or other horizontal support surface, or to be hung on a wall.

A second aspect of the invention relates to display devices in the form of thin panels which bear printed material to be displayed and are constructed to stand on a table top or other horizontal support surface.

Invariably, prior art display devices are made of a number of individual parts which must be assembled by a variety of fabrication operations, all of which add to the cost of their manufacture. Even the simplest known display devices require a frame, separate components for holding a picture or other article to be displayed in the frame and separate components to hold the frame in an upright position on a table top.

Because of the cost unavoidably associated with the manufacture of display devices of this type, their use is not as widespread as it might otherwise be.

BRIEF SUMMARY OF THE INVENTION

Accordingly, it is a primary object of the present invention to provide aesthetically pleasing, practical display devices of the types described above which can be manufactured inexpensively and yet have a high degree of durability.

Another object of the invention is to provide display devices which can be manufactured in a variety of configurations and can be provided with any desired surface finish or decoration.

Still another object of the invention is to provide display devices of the type described above in which an article to be displayed can be mounted in a minimum of time and with a minimum of effort.

The above and other objects are achieved, according to the present invention, by a display device for holding and displaying a document constituted by a thin sheet, the display device comprising: a frame member enclosing a display area; at least one holding element for holding the document so that at least a portion of the document is visible in the display area; and support elements for supporting the frame member in an upright orientation on a horizontal support surface, wherein the at least one holding element is integral with the frame member.

Such a display device according to the present invention can be made from any sheet material which is capable of being die cut, is relatively rigid, or self-supporting, and has at least one layer or stratum that can be bent out of the plane of the frame member by a sufficient amount to be placed behind an article to be displayed without exceeding the elastic limit of that layer or stratum. The sheet material is relatively rigid, or self-supporting, as those terms are employed herein, if the material has a resistance to bending which is such that each component of the display device will retain its original shape when not subjected to any significant external forces.

Preferably, the support elements are made of the same material as the frame member and the at least one holding element. In this case, the frame member, the at least one holding element and the support elements can all be a cut from a single blank.

Objects according to the invention are further achieved by a display device comprising a panel member made of a self-supporting material, the panel member having a forward surface bearing printed material and a lower edge provided with at least one first notch; and a support element engageable in the first notch for holding the panel member in an upright orientation on a horizontal support surface.

The display device according to this embodiment may initially have the form of a card made of the self-supporting material, with the support element forming one edge of the card. The card may be provided with a weakening line constituting a boundary between the panel member and the support element for allowing the support element to be separated from the panel member. Once separated, the support element can be assembled to the panel member and the resulting display device can then be placed on a horizontal support surface with the panel member having an upright orientation. This card can be dimensioned to serve as a mailable post card having a rear surface on which written material can be placed.

DETAILED DESCRIPTION OF THE INVENTION

Figure 1:
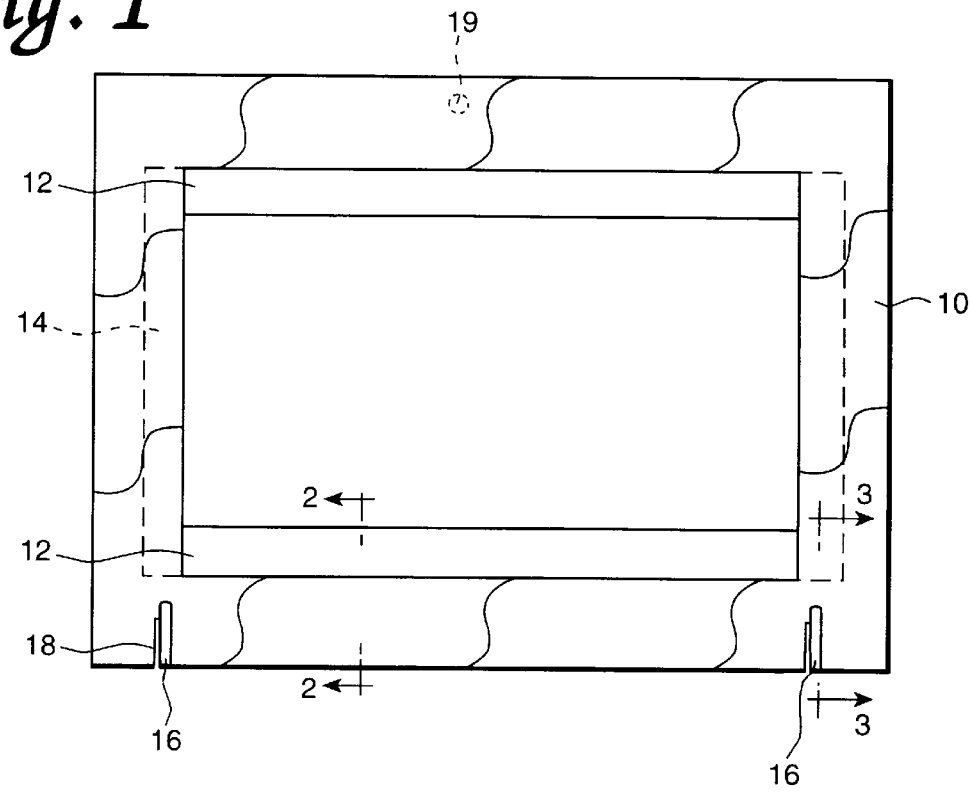
FIG. 1 is a front elevational view of a first preferred embodiment of a display device according to the present invention in its assembled state.

One embodiment of a display device according to the invention is shown in FIG. 1 and includes a generally rectangular frame member 10 that encloses a rectangular display space. The display device further includes, in this embodiment, two holding elements in the form of holding strips 12. Each holding strip 12 is attached to frame member 10 along a respective horizontal edge defining a respective boundary of the display space.

According to a particular novel feature of the present invention, frame member 10 and holding strips 12 are formed from a single piece of material which is scored along the boundaries between holding strips 12 and frame member 10. As will be described in greater detail below, the scoring is carried out in such a manner as to leave a layer or stratum of material that connects frame member 10 to each of strips 12 and allows each strip 12 to be bent toward the rear, away from the plane of FIG. 1, by a sufficient amount to allow a corresponding edge of an article 14 to be inserted over the respective holding strip 12. The outline of article 14 is shown in broken lines in FIG. 1.

Article 14 has upper and lower horizontal edges that will be substantially coextensive with, or inset slightly from, the boundaries between frame member 10 and strips 12 when article 14 is being held in place. Thus, a major portion of the upper and lower edges of article 14 will be positioned in front of strips 12, while right and left end portions of article 14 will be placed behind the vertical sides of frame member 10. Thus, in a simple manner, article 14 will be clamped in place by the vertical sides of frame member 10 and holding strips 14.

Article 14 may typically be a sheet of paper, card stock, plastic, or metal bearing some illustration or other printed material which is to be displayed.

The display device may be completed by two support elements 16 in the form of feet that are shaped to engage in notches 18 formed in the lower edge of frame member 10. Support elements 16 extend rearwardly of frame member 10 and serve to hold frame member 10 in an upright position on a horizontal surface.

Alternatively, frame member 10 may be provided with a hole 19 to allow the frame member to be hung on a wall. According to another alternative, frame member may be hung on a wall with any suitable fastening elements, such as an adhesive fastener. In the case of these embodiments, the notches can be eliminated from frame member 10. However, embodiments of the invention can be constructed to allow frame member 10 to stand on a horizontal surface or to be hung on a wall in one of the ways described herein.

The components of the display device can be made of a variety of materials, as will be described in greater detail below, and these materials allow any desired design or surface decoration, including graphic images, to be printed on, or otherwise affixed to, the front surface of frame member 10, which is the surface viewed in FIG. 1.

Figure 2A:
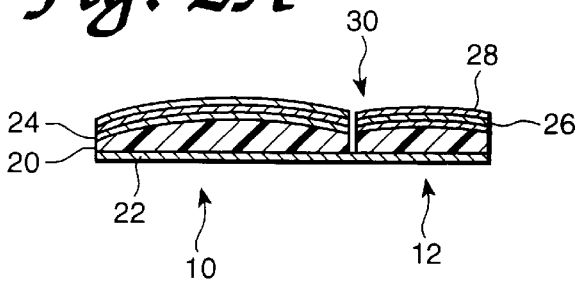
FIGS. 2A, 2B, and 2C are each a cross-sectional view taken along line 2—2 of FIG. 1, showing three possible material compositions from which the display device may be manufactured.
Figure 2B:
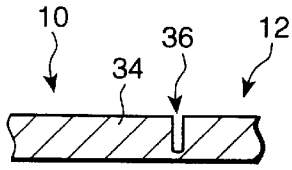
Figure 2C:
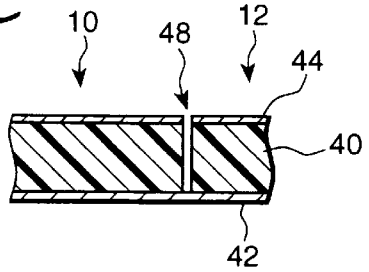

FIGS. 2A, 2B, and 2C are cross-sectional views providing non-limiting examples of materials from which the display device can be made.

FIG. 2A illustrates a laminate composed of a body layer 20 made of a synthetic foam material such as, for example, expanded polystyrene. Body layer 20 is laminated by being sandwiched between two sheets 22 and 24 that may each be made of paper, card stock, or plastic.

According to a first embodiment of the invention, the material from which at least frame member 10 and strips 12 are made may consist solely of body layer 20 and sheets 22 and 24. However, according to a further embodiment of the invention, the material used in the practice of the present invention may be supplemented by a further layer, or sheet, 26 on which a decorative design or motif has been printed and a transparent protective layer 28 which prevents damage to sheet 26 while permitting viewing of the matter printed thereon. Sheet 26 may be made, for example, of paper.

In the case of the above-described embodiments illustrated in FIG. 2A, the resulting material is given its requisite strength and rigidly essentially by body layer 20, which may have a thickness of the order of 0.2 inch. Sheets 24, 26 and 28 do not perform any mechanical function and may therefore have virtually any thickness.

Sheet 22, on the other hand, provides the connection between frame member 10 and each holding strip 12 and must have physical characteristics such that holding strip 12 can be bent toward the rear of frame member 10, i.e. in the downward direction in FIG. 2A, by an amount sufficient to allow an edge of article 14 to be placed over holding strip 12 while the vertically extending edges of article 14 are placed behind vertical sides of frame member 10 without exceeding the elastic limit of sheet 22 and while preventing, or at least minimizing, any bending of article 14. Sheet 22 can provide this combination of flexibility and elastic limit by being made of conventional card stock of suitably selected thickness or by a variety of plastic sheet materials.

In the embodiment illustrated in FIG. 2A, sheets 24, 26 and 28 are shown to have a curved form, which gives the front of frame member 10 a pleasing rounded appearance. This result can be achieved by proper selection of the material for body layer 20, such as expanded polystyrene, as noted above, which is a type of material having no memory when compressed so that, once compressed, it stays in this compressed condition. The requisite compression can be produced when die cutting a sheet of material to form the edges of frame member 10 and holding strips 12, while partially cutting, or scoring, the material at the location of the boundaries between frame member 10 and holding strips 12, as represented by the deep scoring line 30 shown in FIG. 2A.

Preferably, each scoring line 30 cuts entirely through sheet 24 and sheets 26 and 28, if provided, as well as entirely through body layer 20, while leaving sheet 22 intact. However, acceptable results are produced if scoring line 30 extends through only a portion of body layer 20, which may occur because there will always be a certain variation in the cutting depth produced by available scoring equipment. During the die cutting and scoring operations, body layer 20 may be compressed at the cut or scored edges to produce the rounded surface appearance shown in FIG. 2A.

Exemplary compositions of the various components shown in FIG. 2A and techniques for die cutting the components of the display device are disclosed in Issued U.S. Pat. Nos. 4,858,358 and 5,050,323, both of which issued to Raymond Gagnon. Although those patents identify the body layer as being a product marketed under the trademark FOME COR, it is believed that the commercially available product marketed under this trademark is actually composed of such a body layer sandwiched between two sheets corresponding to sheets 22 and 24 of FIG. 2A.

A second embodiment of a material from which the display device according to the invention may be fabricated is illustrated in FIG. 2B. This material is simply a relatively stiff sheet 34 of cardboard or card stock which can be die cut and scored, at scoring line 36, in the manner described above with respect to the embodiment of FIG. 2A.

A third embodiment of such material is illustrated in FIG. 2C and is composed of a body layer 40 sandwiched between two sheets of paper, card stock, or plastic 42 and 44. Here, body layer 40 may be made of a material, such as a styrofoam, which does have sufficient memory that it will not be permanently compressed during die cutting and scoring. In FIG. 2C, the score line between frame member 10 and holding strip 12 is indicated at 48.

Figure 3:
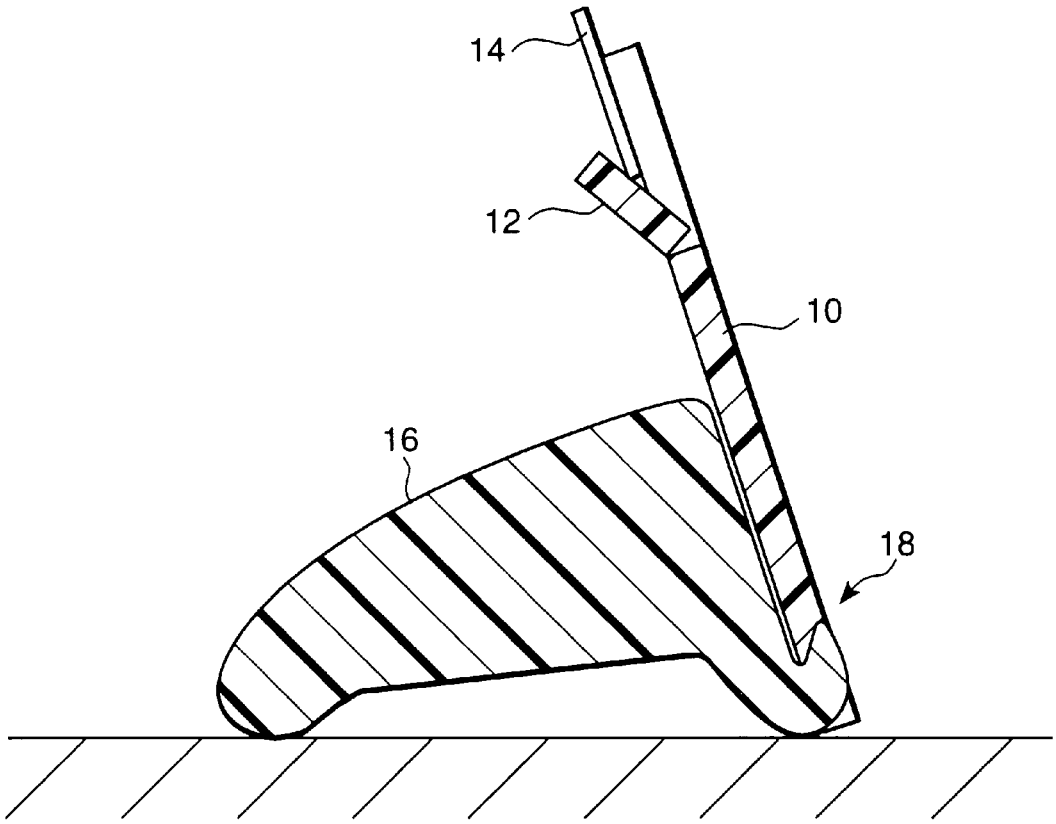
FIG. 3 is an elevational, cross-sectional detail view of the lower portion of the display device of FIG. 1.

The display device shown in FIG. 1 is further illustrated in the cross-sectional view of FIG. 3, from which it can be seen that each support element 16 is provided, at its front edge, with a recess which seats around the upper nd, or base, of an associated notch 18. Each element 16 is further provided with two downwardly protruding support portions which, when resting upon a horizontal support surface, impart the desired inclined or vertical orientation to frame member 10.

Support elements 16 may be made of the same material as frame member 10 and holding elements 12. Therefore, all components of a display device according to the invention can be fabricated in a simple and economical manner by simply die cutting and scoring a blank sheet of the material.

Figure 4:
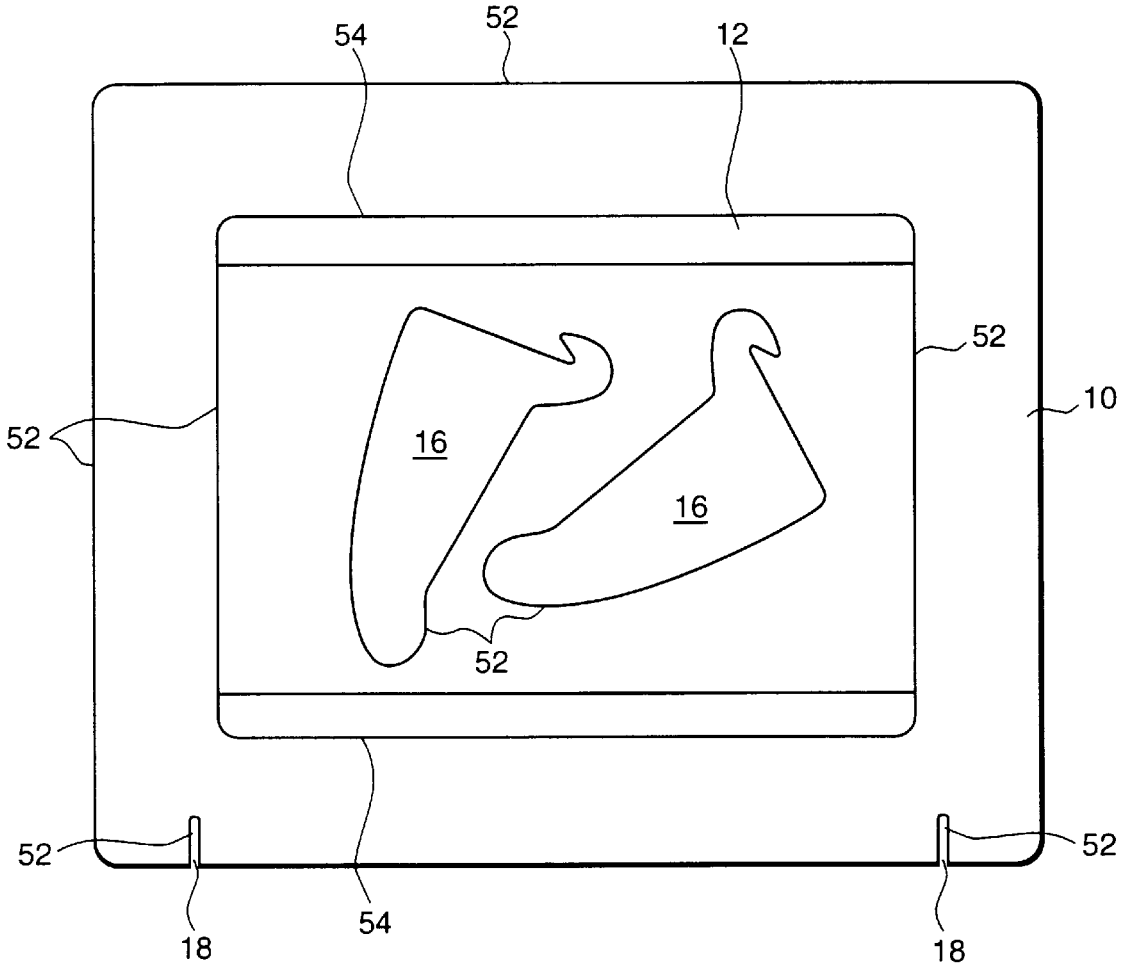
FIG. 4 is a front elevational view showing a sheet of material which has been cut to form all of the components of the display device of FIG. 1.

FIG. 4 shows such a sheet subsequent to die cutting and prior to separation of the various elements from the sheet. The sheet has been die cut through its entire thickness along the entirety of lines 52 and has been scored, or partially cut through, as described above, along lines 54 which constitute the boundaries between frame member 10 and holding strips 12.

While the first embodiment of the present invention has been described with reference to a rectangular frame having a rectangular display space, it will be appreciated that embodiments of the invention can have a wide variety of outline shapes, both for the periphery of frame member 10 and the periphery of the enclosed display space. These shapes can be polygons other than rectangles, ovals, which may be flattened along the lower edge of the frame, etc.

Figure 5:
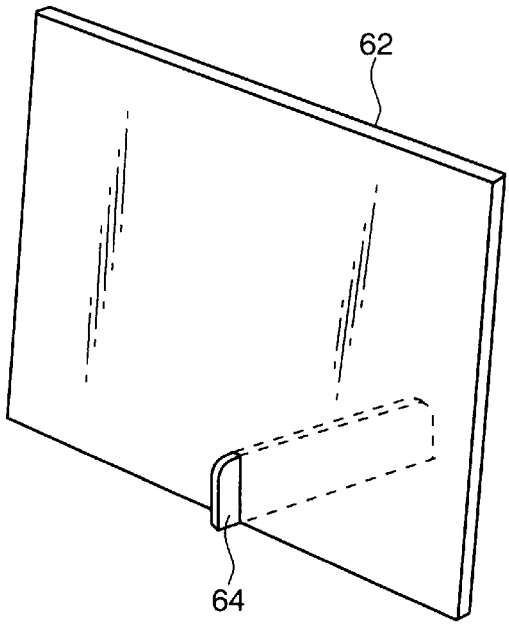
FIG. 5 is a plan view of a card having parts which can be assembled to constitute a second preferred embodiment of a display device according to the invention.
Figure 6:
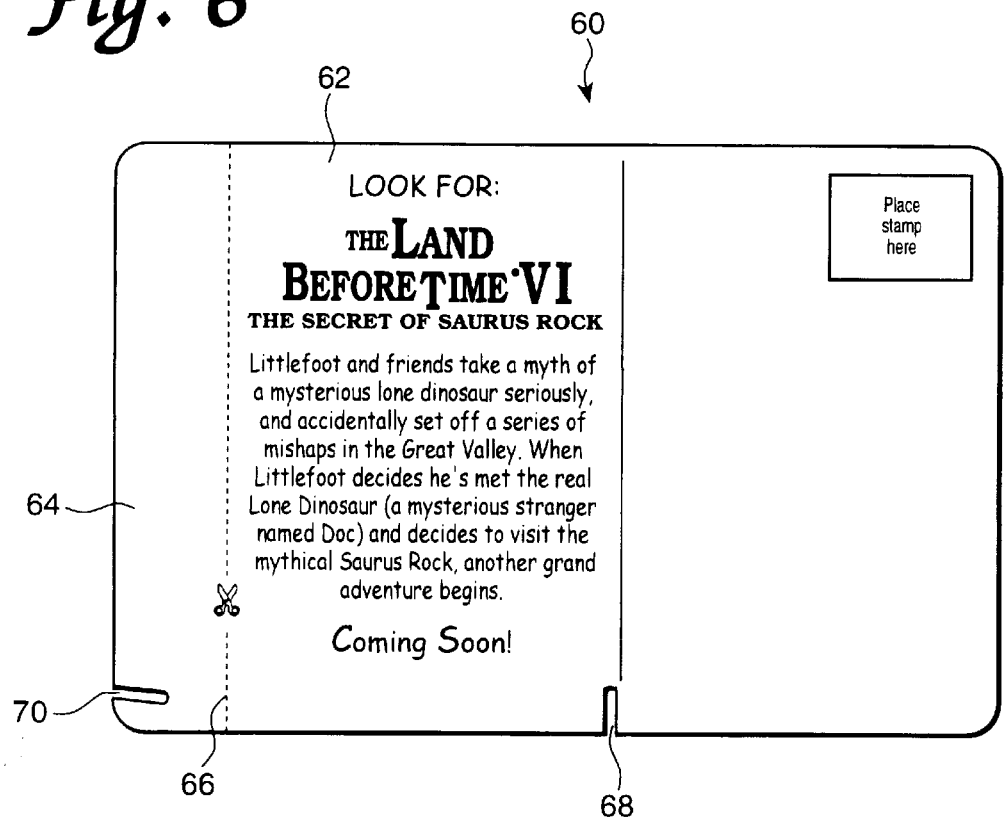
FIG. 6 is a perspective view of a display device formed from portions of the card shown in FIG. 5.

A second preferred embodiment of the invention is shown in FIGS. 5 and 6. FIG. 5 is a plan view showing the rear surface of a card which is dimensioned to be a mailable post card, while FIG. 6 is a perspective view showing the forward surface of a panel member which is created when the card shown in FIG. 5 is cut into two parts.

Referring specifically to FIG. 5, card 60 is composed of a panel member portion 62 and a support element 64, the two portions being joined together at a line 66 along which the card material has been weakened, at the front surface of the card, to facilitate separation of the two portions from one another by cutting along line 66.

Preferably, this weakening is effected by scoring card 60 starting from the forward surface thereof. Most preferably, this scoring is performed along individual sections of line 66 so that narrow portions of the card material are left intact at the card front surface. This will ensure that the card retains sufficient rigidity and integrity while being conveyed through the postal system.

Panel member portion 62 is provided along one edge with a notch 68 and support element portion 64 is also provided with a notch 70 along one edge. Notch 68 is located at the center of its associated edge, while notch 70 is located near one end of its associated edge.

After portions 62 and 64 have been separated from one another by cutting along line 66, they will be assembled together in the manner shown in FIG. 6, with notch 70 engaging in notch 68. When thus assembled, support element portion 64 will retain panel member portion 62 in an upright orientation, as illustrated, with the printed matter on the front surface of panel member portion 62 being displayed.

While the second embodiment has been shown and described as being in the form of a rectangular post card, it will be appreciated that articles according to this embodiment can take a wide variety of other shapes, some of which will also be suitable for use as a post card. However, the panel member portion of such an article can also be given any arbitrarily selected outline and this outline can be coordinated with the printed material provided on the front surface to constitute a replica of a person, a cartoon character, an animal, a famous building, a product, etc.

The embodiment shown in FIGS. 5 and 6 can be made from any of the materials illustrated in FIGS. 2A, 2B, or 2C, as well as variations of those materials and any other materials described above with reference to the embodiment shown in FIGS. 1 and 3.

According to another form of construction of the embodiment shown in FIGS. 5 and 6, panel member portion 62 can be provided with two notches along one edge, and card 60 can have two support element portions, each extending along a respective one of two opposed edges of the card, with a weakening line being formed between each support element portion and the panel member portion.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A display device for holding and displaying a document constituted by a thin sheet, said display device comprising:

a frame member having a forward surface that is visible when the document is in position to be viewed and enclosing a display area; and first and second holding elements for holding the document so that at least a portion of the document is visible in the display area, wherein said first and second holding elements are integral with said frame member, said display area has first and second edges, said first edge is located opposite to said second edge, said first holding element extends along, and is connected to, said first edge and said second holding element extends along, and is connected to, said second edge;

said frame member and said holding elements are made from a single piece of material which has a thickness having a direction perpendicular to the forward surface and said piece of material being cut in the direction of the thickness to form a first score line which constitutes a first boundary between said frame member and said first holding element and a second score line which constitutes a second boundary between said frame member and said second holding element, the score lines extending through a part of the thickness of the piece of material to leave, at each score line, a stratum of the material which connects a respective one of said holding elements to a respective edge of said display area.

2. The display device of claim 1 wherein said stratum of material between each said holding element and said frame member has an elastic limit which allows each said holding element to be bent relative to said frame member by an amount sufficient to enable the document to be placed over each said holding element without exceeding the elastic limit.

3. The display device of claim 2 wherein said frame member has a forward surface that is visible when the document is in position to be viewed, said forward surface having an arcuate form.

4. The display device of claim 1 further comprising support elements for supporting the frame member in an upright orientation on a horizontal support surface.

5. The display device of claim 4 wherein said frame member has a lower edge provided with a plurality of notches and each of said support elements is retained in a respective one of said notches.

6. The display device of claim 4 wherein said support elements are made of the same material as said frame member and said holding elements.

7. The display device of claim 6 further comprising a sheet bearing a decorative design covering the forward surface of said frame member.

8. The display device of claim 7 made by the steps of:

die cutting a blank of a self-supporting material to form said support elements and a part containing said frame member and said holding elements;

scoring the part along lines constituting boundaries between said frame member and said holding elements; and connecting said support elements to said frame member.

9. The display device of claim 1 wherein said frame member and said holding elements are made of a material constituted by a foam core and two component layers laminated to, and sandwiching, said core.

10. The display device of claim 1 wherein said frame member and said holding elements both have the thickness of the material.

11. The display device of claim 10 wherein said first holding element is coextensive in length with said first edge and said second holding element is coextensive in length with said second edge.

12. The display device of claim 1 wherein said first holding element is coextensive in length with said first edge and said second holding element is coextensive in length with said second edge.

13. The display device of claim 1 wherein the display device has no holding elements other than said first and second holding elements.

* * * * *